United States Patent [19]

Miya

[11] 3,961,635

[45] June 8, 1976

[54] HAIR TREATING LIQUID APPLICATOR

[75] Inventor: Yoichi Miya, Tokyo, Japan

[73] Assignee: Shiseido Co., Ltd., Tokyo, Japan

[22] Filed: Dec. 30, 1974

[21] Appl. No.: 537,510

[30] Foreign Application Priority Data

| | | |
|---|---|---|
| Dec. 29, 1973 | Japan | 49-1154[U] |
| Dec. 29, 1973 | Japan | 49-1155[U] |
| Dec. 29, 1973 | Japan | 49-1156[U] |
| Jan. 28, 1974 | Japan | 49-11824[U] |
| Mar. 30, 1974 | Japan | 49-36412[U] |

[52] U.S. Cl. ..... 132/11 R; 132/113

[51] Int. Cl.[2] ..... A45D 20/00

[58] Field of Search ..... 132/9, 11, 113, 152, 132/112, 114, 116; 221/60

[56] References Cited

UNITED STATES PATENTS

| | | | |
|---|---|---|---|
| 812,241 | 2/1906 | Shubert | 132/113 |
| 1,305,226 | 5/1919 | Kunkler | 132/152 |
| 1,482,242 | 1/1924 | Michaud | 132/152 |
| 1,956,558 | 5/1934 | Berry | 221/60 |
| 2,794,443 | 6/1957 | Moore | 132/113 |
| 3,457,928 | 7/1969 | Kurshenoff | 132/113 |
| 3,714,950 | 2/1973 | Miska et al. | 132/112 |

*Primary Examiner*—G.E. McNeill

*Attorney, Agent, or Firm*—Sughrue, Rothwell, Mion, Zinn & Macpeak

[57] ABSTRACT

An applicator and device for depositing and distributing a liquid on the hair is disclosed which has a flexible supply reservoir, a cap portion attached to the reservoir, and a comb tooth support member attached to the cap portion, the comb tooth support member having several comb teeth attached thereto. By manually squeezing the flexible supply reservoir, the hair treating liquid is forced through passage ways through the cap portion, the comb tooth support member and through passages in each of the comb teeth. The exit passages of the comb teeth are located approximately at the mid-point between the ends of the comb teeth. This allows the application of the liquid to the hair without the liquid coming into direct contact with the scalp. The comb teeth may be individually attached to the comb tooth support member, or may be attached to a common base which is, in turn, attached to the comb tooth support member. The comb tooth support member and the comb teeth may also be attached to an aerosol type supply reservoir instead of the manually squeezable flexible supply reservoir.

10 Claims, 19 Drawing Figures

HAIR TREATING LIQUID APPLICATOR

THE FIELD OF THE INVENTION

The invention relates to a device for manually applying a hair treating liquid, such as a dye or coloring, to the hair.

DESCRIPTION OF THE PRIOR ART

Applicator devices for applying a hair treating liquid to the hair having flexible supply containers which are manually squeezed in order to force the hair treating liquid from the container into a distributing apparatus are well known in the art, and are typified by U.S. Pat. No. 2,755,807 to Jorgensen, U.S. Pat. No. 3,457,928 to Kurshenoff, and U.S. Pat. No. 3,477,447 to Eldredge. These typical prior art devices utilize a distributing device attached to the flexible container to distribute the hair treating fluid evenly throughout a section of the hair and scalp. The most usage of such devices is to apply a hair coloring fluid in order to alter the color of the operator's hair.

As is often the case, the hair coloring fluids contain ingredients which cause damage to the scalp of the user if applied directly thereto, instead of the hair itself. The prior art devices have no means with which to prevent the hair treating fluid from coming into contact with the scalp of the user. Also, the distributing apparatus utilized by the prior art devices has a plurality of comb-like teeth, which are integrally molded with a common supply tube attached to the flexible reservoir, this integral molding requires a complex mold apparatus and, thereby, serves to increase the cost of such devices. Also, if one of the comb teeth should be broken off, the effectiveness of the distributing apparatus is totally destroyed.

And also U.S. Pat. No. 3,754,557 to Moore and U.S. Pat. No. 3,818,917 to Hudson disclose that the openings of each comb tooth are positioned at the root portion thereof or positioned on the comb tooth support member so that these prior art applicators do not give the damage of scalp, however, these types of applicators cannot fully apply a hair treating liquid to the root portion of hair.

Further, U.S. Pat. No. 1,384,671 to Murray attains same purpose as our invention, namely, the opening of each of the comb teeth is positioned at the mid point between the ends of the comb teeth to prevent damage of scalp and to fully apply the hair treating liquid to the root portion of the hair, however, there is no description regarding to the structure of the comb portion which is formed by combination of the comb teeth and comb tooth support member and the method for fixing the comb teeth to the comb tooth support member firmly.

SUMMARY OF THE INVENTION

The invention relates to an applicator device for depositing and distributing a liquid on the hair which prevents the hair treating fluid from coming into direct contact with the user's scalp, while at the same time it is economical to manufacture and assemble. The complicated device according to the present invention comprises a supply reservoir, a cap portion attached to the supply reservoir, a comb tooth support member attached to the cap, and a plurality of comb teeth affixed to the comb tooth support member. Passage ways through the cap portion, the comb tooth support member, and each of the comb teeth allow the fluid to flow from the supply reservoir and out of each of the comb teeth onto the hair of the user. The openings on each of the comb teeth are located approximately at the mid-point between the ends of the comb teeth, to prevent the hair treating fluid from coming indirect contact with the operator's scalp. This eliminates the possibility of irritation to the scalp caused by the hair treating fluid.

The invention also makes possible the replacement of individual comb teeth, or all of the comb teeth on the comb tooth support member to obviate the necessity of disposing of the entire distributing apparatus if one of the comb teeth should be broken. The removable comb teeth also allows simpler molds to be utilized in fabricating the distribution device and, thereby, reduces the cost of manufacturing such device.

The comb tooth support member may be rotatably affixed to the cap portion to allow the user to position the comb teeth in various positions with respect to the supply container, thereby enabling usage on all parts of the user's hair. Additionally, the comb tooth support member and the comb teeth may be attached to an aerosol type container to facilitate application of the hair treating fluid to the operator's hair.

DETAILED DESCRIPTION OF THE INVENTION

Figure 1:
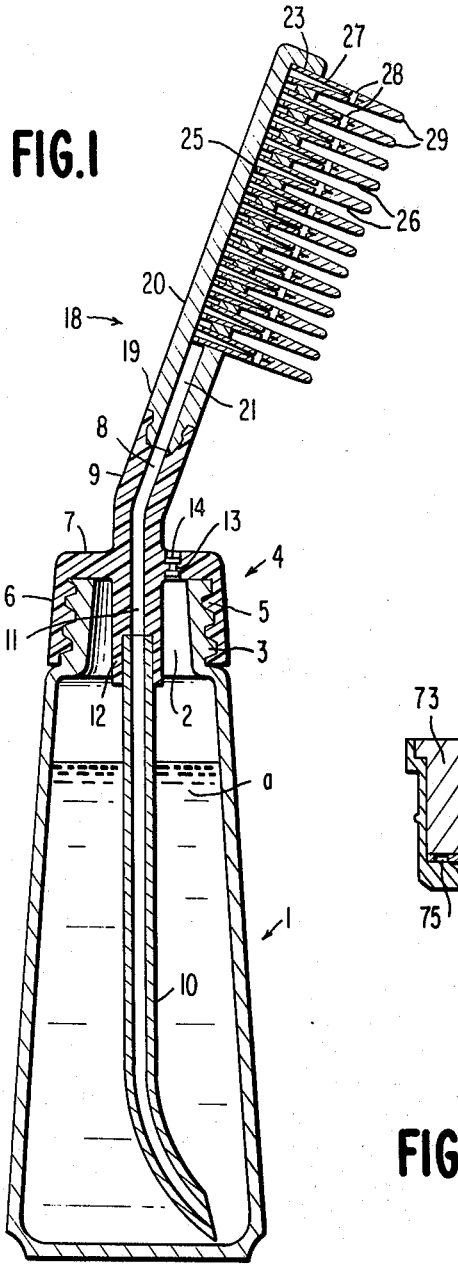
FIG. 1 is a sectional view of a hair treating liquid applicator according to a first embodiment of the invention.

The present device relates to improvements in a hair treating liquid applicator for applying to the hair a hair treating liquid including a hair oil, a hair washing liquid or a hair dye. The device provides a convenient applicator which can accomplish effective application ot the hair treating liquid by a simplified operation and which can be manufactured and assembled with ease.

The present device will now be described in conjunction with the accompanying drawings. Indicated at FIG. 1, reference numeral 1 is a flexible container, which has a shape suitable for hand gripping and which has a neck portion 2 formed with an external spiral thread 3. Indicated at numeral 4 is a cap portion, which includes an annular wall 6 formed with an internal spiral thread 5 which engages the external spiral thread 3 formed on the neck portion 2 of the container 1. The cap 4 further includes a head plate 7 and an outside cylinder 9, which extends at a suitable angle from the upper surface of the head plate 7 and which has a liquid passageway 8 in its inside. Within the cap 4 there is also incorporated an inside cylinder 12, which extends from the lower face of the head plate 7. The inside cylinder 12 has a suction tube 10 which depends therefrom and which has its lower end extending to the bottom of the container 1. The inside cylinder also has in its inside a liquid passageway 11 which has communication with the liquid passageway 8 of the outside cylinder. The cap 4 further includes a valve 14 which is mounted in an air vent hole 13 through the head plate 7.

Figure 2:
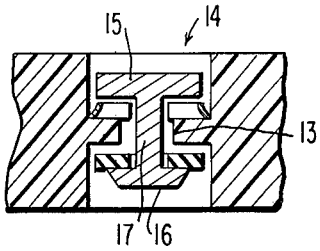
FIG. 2 is an enlarged sectional view of a valve utilized in the embodiment of FIG. 1, showing the valve in an open position.
Figure 3:
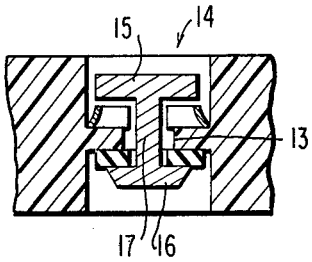
FIG. 3 is an enlarged sectional view of the valve of FIG. 2, showing the valve in a closed position.
Figure 4:
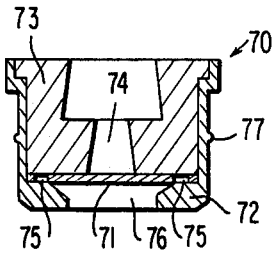
FIG. 4 is an enlarged sectional view of another type of a valve unit utilized in the embodiment of FIG. 1.
Figure 5:
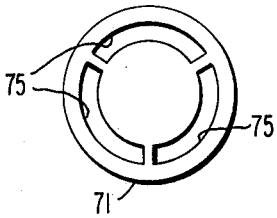
FIG. 5 is a plane view of the valve diaphragm of the valve of FIG. 4.

As shown in FIGS. 2 and 3, the valve 14, has an I-shaped longitudinal section, and includes an upper valve main body 15, a lower pressure-receiving disc 16, and a valve stem 17 connecting the two elements 15 and 16. Thus, both in the normal condition and when the container 1 is squeezed, the valve 14 is in the closed position, in which the lower pressure-receiving disc 16 assumes the position, as shown in FIG. 3, by the action of packing which is adhered to the inside surface of the I-shaped valve 14. On the other hand, when the valve 14 in the air vent hole 13 has its valve main body 15 pushed down, the ambient air enters the container 1, until the container 1 returns to its normal condition after the squeezing action is stopped, so that the air vent hole 13 may be opened as shown in FIG. 2. Here, it should be understood that the valve to be mounted in the air vent hole need not be limited to the type having the I-shaped section but may be of any type. For example, as shown in FIGS. 4 and 5, a valve is produced as one final product and the valve can be set up in the cap of the applicator. In such a case, the function of the valve unit can be changed before set up in the cap, and also makes it possible to replace the valve unit easily if the valve unit is broken at the time of use.

Indicated numeral 71 is a valve diaphragm which provides air vent holes 75, numeral 72 is a cup-like shaped valve support member which provides air vent holes 76 at its bottom portion and a engaging rib at its outer peripheral wall so as to fix with a cap of the applicator, numeral 73 is a cup-like shaped valve diaphragm press member which provides air vent holes 74 at its bottom portion. Only when the applicator is free from squeezing and its inner side becomes pressure reducing condition, the valve diaphragm 71 is pressed to the direction of the inner side of the applicator by atmosphere and the air can be flown into the applicator through the air vent holes 74, 75 and 76.

Figure 8:
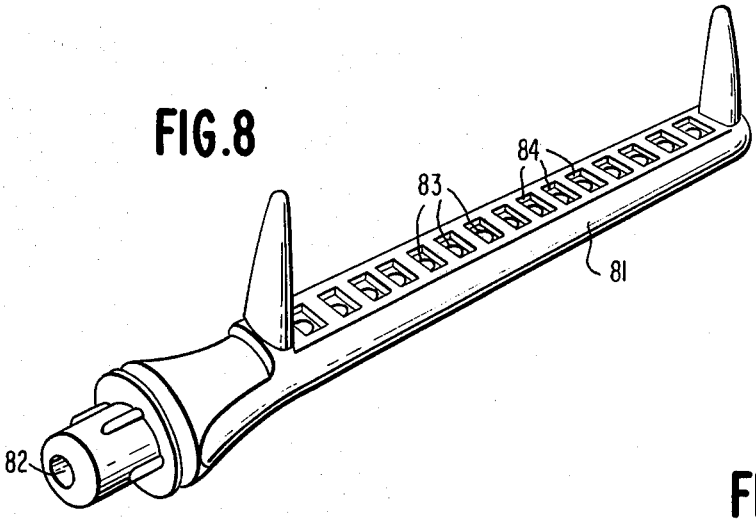
FIG. 8 is an exploded perspective view showing the mounting of the comb teeth of another embodiment of FIG. 1.
Figure 9:
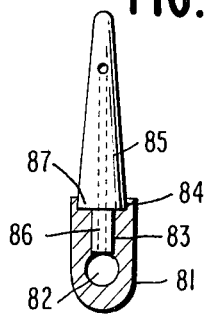
FIG. 9 is an enlarged sectional view of FIG. 8.

Indicated at numeral 18 is a comb tooth support member, which includes a base portion 19, a ridge portion 20 and a multiplicity of juxtaposed comb teeth 26. The base portion 19 is fitted into the upper end of the outside cylinder 9 which is formed in the cap 4. The ridge portion 20 is formed in its inside with a liquid passageway 21, which is in communication with the liquid passageway 8, and with retaining grooves 22 which are formed in the side edges of the liquid passageway 21. Each of the comb teeth 26 has a base end 23 which is fitted into one of the side edges of the ridge portion 20 which is formed with projections 24 engageable with the retaining grooves 22. The comb teeth 26 also have a side bore 25 which opens into the inside of the liquid passageway 21. In the comb teeth 26 there is formed a liquid supply passage 27, which is in communication with the side bore 25. In the comb teeth 26 are also formed ejection holes 28, each of which is formed intermediate the base end 23 and the leading ends 29 of the comb teeth 26, and is in communication with the liquid supply passage 27. Another embodiment of the engaging portion of the comb teeth and the comb tooth support member as is shown in FIGS. 8 and 9. The comb tooth support member 81 has a liquid passage way 82 and comb teeth set up holes 83 which passes to said liquid passage ways and comb teeth mounting groove 84 which shape is rectangular in horizontal cross section, and the comb tooth has a set up portion 86 and a comb tooth base portion 87 to engage with said comb teeth set up holes 83 and comb teeth mount groove, respectively. In practice, each sizes of the comb teeth is formed in larger than the set up hole 83 and comb teeth mount groove 84 of the comb tooth support member and set up forcibly.

It can prevent the unsteady of the comb teeth and the set up the comb teeth in good order in one direction by double stepped engaging portion of the comb tooth support member as described in above.

In the operation of the applicator having the above-described construction, a suitable hair treating liquid *a* is first poured into the flexible container 1. Then, this container 1 is manually grasped and squeezed so that the hair of the particular operator may be subjected to the combing treatment by the multiple comb teeth 26 which are formed on the comb tooth support member 18 fitted to the upper portion of the container 1 through the cap 4.

As the container is manually squeezed, the valve 14, which is mounted in the air vent hole 13 formed in the head plate 7 of the container 1, closes the air vent hole 13 so that the inside of the container is hermetically sealed. By the squeezing operation, therefore, the hair treating liquid *a*, which is confined in the container 1, will go up in the suction tube 10 to flow into the liquid passageway 8 of the outside cylinder 9 by way of the liquid passageway 11 of the inside cylinder 12. Then, the liquid *a* will pass through the liquid passageway 21, which is formed in the ridge portion 20 fitted into the upper end of the outside cylinder 9 and which has communication with the liquid passageway 8. The liquid *a* will further pass through the side bore 25, which opens into the inside of the liquid passageway 21, of the comb teeth 26, which has its base end 23 fitted into one of the side edges of the ridge portion 20, and then through the liquid supply passage 27, which has communication with the side bore 25, and will be finally ejected to the outside or to the hair through the ejection holes 28, each of which is formed at such an intermediate portion of the comb teeth 26 spaced from the leading ends 29 and as has communication with the liquid supply passage 27. Thus, the desired hair treating liquid can be applied to the hair. When the squeezing action of the container 1 is stopped, the valve 14, which has closed the air vent hole 13, will keep the air vent hole 13 open until the container 1 resumes its initial shape, so as to provide air communication between the inside and outside of the container 1, thus instantly stopping ejection of the hair treating liquid.

To assemble the applicator according to the present invention, the cap 4 is at first screwed onto the neck portion 2 of the container 1, and then the ridge portion 20 constituting the comb tooth support member 18 is fitted into the upper end of the outside cylinder 9. Then, the base end 23 of each of the comb teeth 26 is fitted into one of the side edges of the ridge portion 20. As a result, the projections 24, which are formed on the base end 23, are brought into engagement with the retaining grooves 22 which are formed in the ridge portion 20. Thus, the device can be easily assembled with the comb teeth 26 being firmly fixed to the present applicator without any fear of getting out of place. It should also be appreciated that, since the comb teeth are produced separately of the other elements, a complicated mold can be dispensed with and their production cost can be materially reduced. Moreover, since the ejection holes 28 are formed substantially at a position spaced from leading ends 29 of the comb teeth, the hair treating liquid can be effectively applied only to the hair without being applied directly to the skin.

Figure 6:
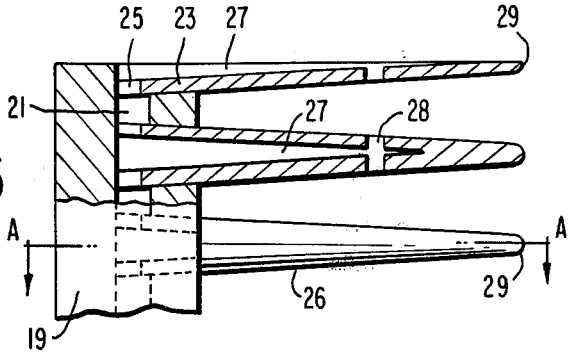
FIG. 6 is an enlarged partial sectional view showing the mounting of the comb teeth in the embodiment of FIG. 1.
Figure 7:
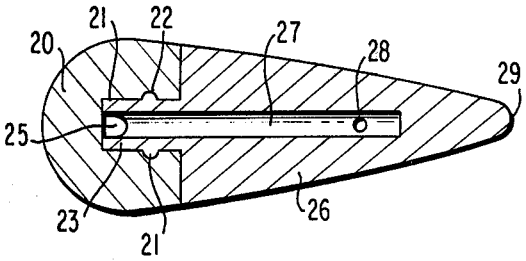
FIG. 7 is an enlarged sectional view showing the mounting of the comb teeth of FIG. 6.
Figure 10:
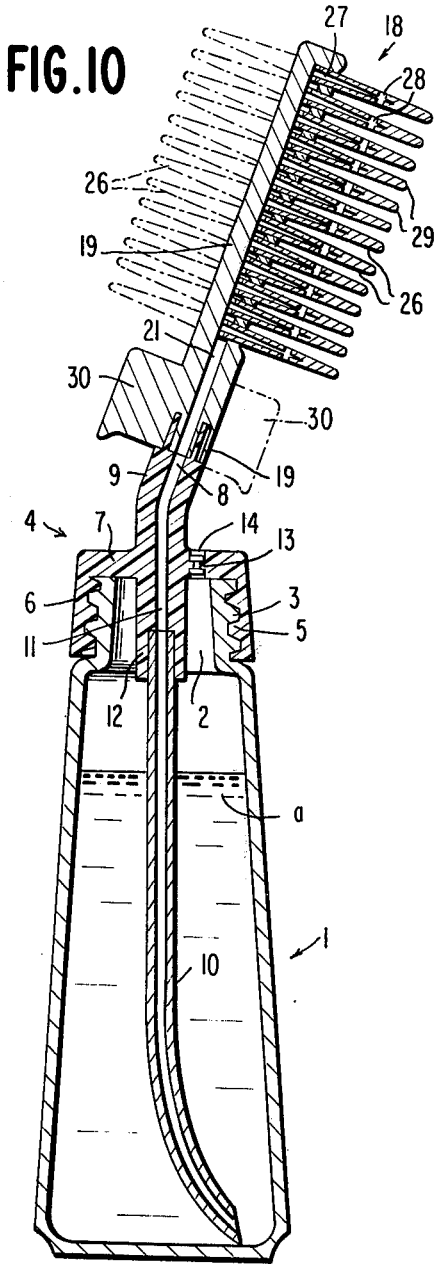
FIG. 10 is a sectional view of a hair treating liquid applicator according to a second embodiment of the invention.
Figure 11:
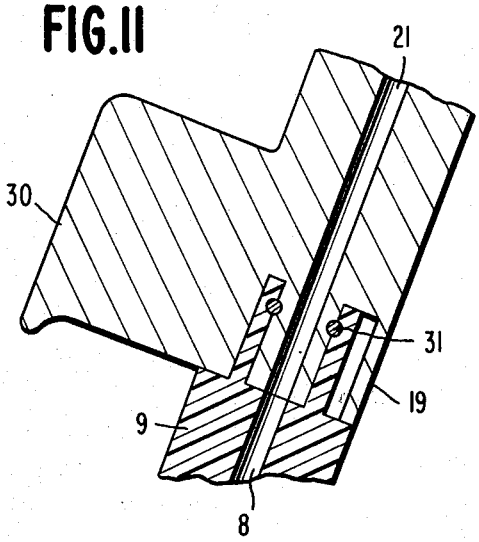
FIG. 11 is an enlarged sectional view of the joint of the embodiment of FIG. 10.
Figure 12:
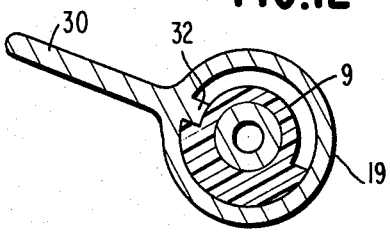
FIG. 12 is a cross sectional view of the joint of FIG. 11.
Figure 13:
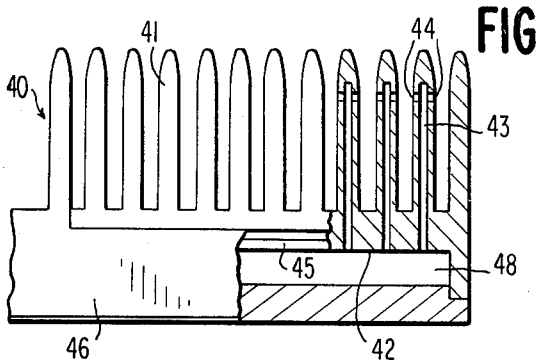
FIG. 13 is a partial sectional view of a hair treating liquid applicator according to a third embodiment of the invention.
Figure 14:
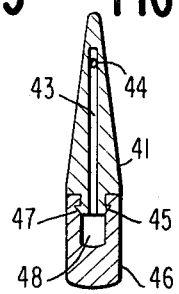
FIG. 14 is a cross sectional view of the embodiment of FIG. 11.
Figure 15:
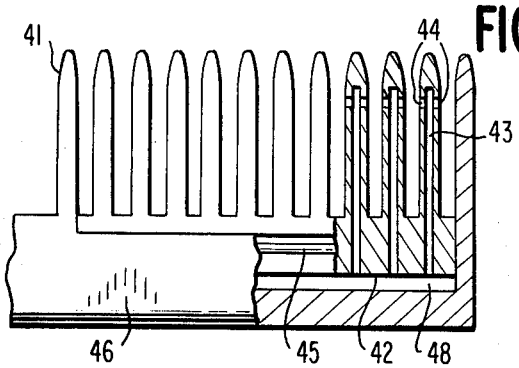
FIG. 15 is a partial sectional view of a hair treating liquid applicator according to a fourth embodiment of the invention.
Figure 16:
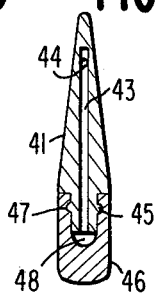
FIG. 16 is a cross sectional view of the embodiment of FIG. 15.

Instead of being rigidly attached to the upper end of the outside cylinder 9, the ridge portion 20 may be rotatably attached thereto as shown in FIGS. 10 – 12. In this case, rotating lever 30 is attached to, or made integrally with, base portion 19 of the comb tooth support member 20. O ring 31 provides the sealing effect between the outside cylinder 9 and the ridge portion 20 to prevent escape of the hair treating fluid during use of the device. As shown in FIG. 12, a stop 32 may be provided extending from the interior of base portion 19 and engaging a portion of the upper end of outside cylinder 9 so as to limit the rotation of the ridge portion 20. A rotation of 180° is shown, but the dimensions of the stop and outside cylinder may be chosen to limit the rotation to any desired valve. By turning the rotating lever 30 which is mounted in the base portion 19, therefore, the comb teeth 26 can be moved along the head in a satisfactory manner to apply the hair treating liquid to the intended portion of the head. For instance, when it is intended to apply the liquid to the top or back of the head, the comb teeth 26 of the comb tooth support member 18 can be directed downwardly with respect to the container 1, as shown by the solid lines in FIG. 6. Likewise, when it is intended to apply the liquid to the sides of the head, the comb teeth 26 can be directed upwardly with respect to the container 1, as shown by the dotted lines in FIG. 10.

Instead of each of the comb teeth 26 being individually attached to ridge portion 20, they may be molded integrally with a common base portion, which, in turn, is attached to the ridge portion 20. This embodiment is shown in FIGS. 13 – 18.

Indicated at reference numeral 40 is a comb-like member, which is formed with a plurality of comb teeth 41 and with a base frame 42 integrally supporting the comb teeth 41. In the center of the respective comb teeth 41 there is formed a flow hole 43, which has its one end open through the base frame 42. At the other closed end of the flow hole 43, there is formed an ejection port 44, which is open in the surface of the comb tooth 41 and located at a position spaced from the leading end of the tooth as previously described. Indicated at numeral 45 are engagement projections which are formed in the longitudinal side surfaces of the base frame 42.

Indicated at numeral 46 is a comb-tooth support member, which is formed with concave engagement grooves 47. These grooves 47 are formed in the confronting inner side walls of the comb-tooth support so as to engage with the projections 45 of the base frame 42. There is also formed a supply groove 48, through which the hair treating fluid is supplied to the flow holes 43. The comb tooth support member 40 is attached to a flexible container 1 by way of outside cylinder 9 such that supply groove 48 communicates with passageway 8. The member may be rigidly affixed to the outside cylinder 9, as shown in FIG. 1, and pivotally attached thereto using the joint shown in FIG. 10.

Figure 17:
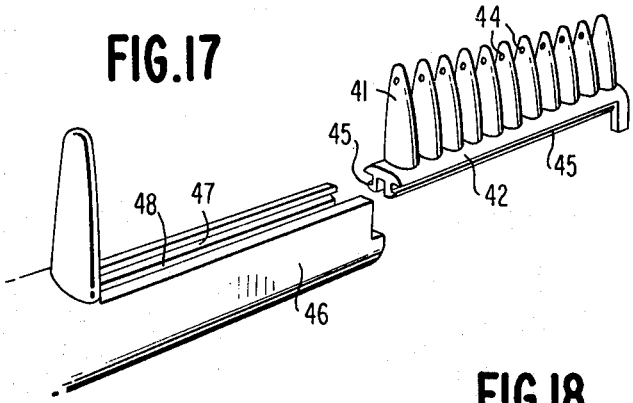
FIG. 17 is an exploded perspective view showing the embodiment of FIG. 12.
Figure 18:
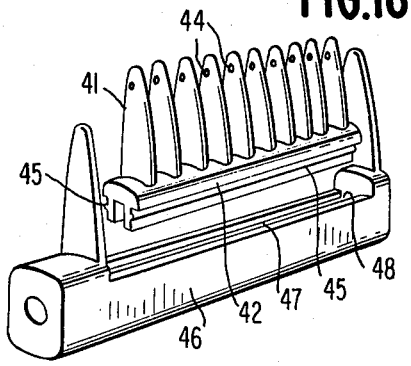
FIG. 18 is an exploded perspective view showing the embodiment of FIG. 15.

The base frame 42 may be fabricated such that the engagement projections 45 are slid into engagement with the grooves 47, as shown in FIG. 17, or such that they "snapped" into engagement by a force perpendicular thereto, as shown in FIG. 18. In this instance, the longitudinal side surfaces of base frame 42 deform slightly to allow the engagement projections to pass over the inner side walls of the comb tooth support member and into engagement with grooves 47.

Once the comb-tooth support member is attached to the outside cylinder 9, the device is used in a similar fashion to the embodiments previously described.

In addition to a flexible manually squeezed hair treatment container, the application of the present invention may also be utilized in conjunction with an aerosol type spray container.

Figure 19:
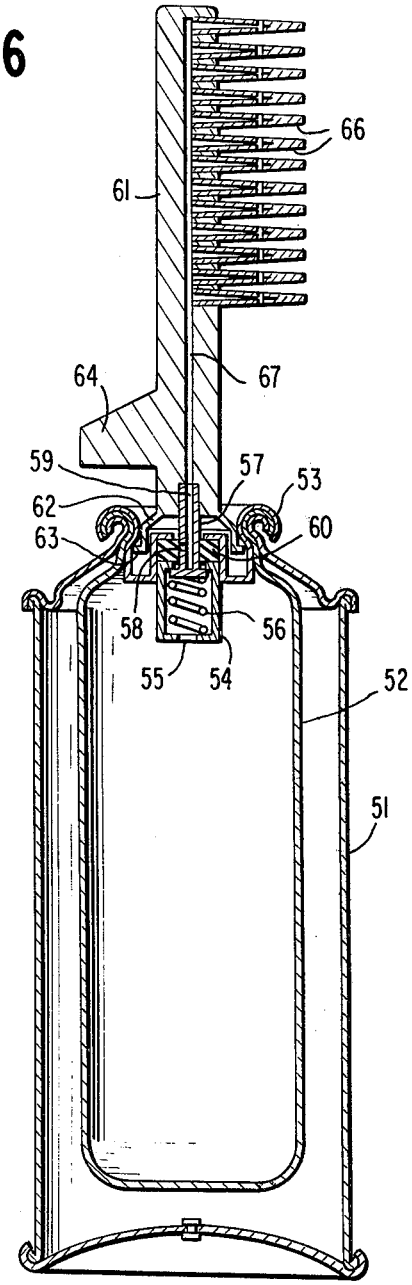
FIG. 19 is a sectional view of a hair treating liquid applicator according to a fifth embodiment of the invention.

As shown in FIG. 19, an aerosol container main body 51 contains a liquid confining bag 52 fixed to a mounting cap 53. This bag 52 is made deformable since it is made of a plastic synthetic resin or metal, especially, formed from flexible aluminum sheet. A hair treating liquid such as hair tonic, hair oil, hair dye or a hair washing liquid is confined in the bag 52. Gases under pressure are filled in the aerosol container main body 51 outside of the liquid confining bag 52.

Indicated at numeral 54 is a valve casing which is secured to the lower face of the mounting cap 53. A suction port 55 is formed in the bottom wall of the valve casing 54, and a valve stem 57 is inserted in the valve casing 54 through a spring 56. Numerals 58 and 59 indicate a side hole of the valve stem 57 and a communication hole having communication with the side hole 58, respectively. Indicated at numeral 60 is an elastic annular valve, which is made of rubber or the like and which normally closes the side hole 58. A comb-tooth support member 61 is attached to the aerosol container main body 51 by fitting its fixture portion 62 into the mounting cap 53. An engagement flange 63 is formed on the outer periphery of the fixture portion 62, which the upper portion of the valve stem 57 and a supply groove 67 are merged into each other for providing communication therebetween. It goes without saying that the attachment of the comb-tooth support member 61 to the mounting cap 53 can be accomplished with the use of suitable screw means.

The comb teeth 66 may be attached to comb tooth support member 61 in any of the ways as described in the previous embodiments. The teeth 66 are so constructed as to communicate with supply groove 67. A push lever 64 is attached to or formed integrally with comb tooth support member 61. In operation, the push lever 64 is pushed down to lower the comb tooth support member 61 and the valve stem 57, which has its upper portion fitted into the lower portion of the member 61, is also pushed down against the counter biasing action of the spring 56. Then, the side hole 58 of the valve stem 57 is released from its closed condition by valve 60. Since, at this instant, the propellent gases under pressure are confined in the container main body 51 outside of the liquid confining bag 52, this bag 52 is subjected to the pressure due to the propellent gases, so that the hair treating liquid will be discharged to the outside from the respective ejection holes in the comb teeth, after having passed through the suction port 55, the valve casing 54, the side hole 58 of the valve stem 57, the communication hole 59 and the supply groove 67 of the comb teeth support member 61 in this order.

When the pushing action of the push lever 64 of the comb tooth support member 61 is stopped, the valve stem 57 and the member 61 will restore their initial positions due to the counter-acting force of the spring 56, with the resultant closing of the side hole 58 of the valve stem 57 by the valve 60. As a result, it will be apparent that the ejection of the liquid from the bag 52 is terminated.

What is claimed is:

1. An applicator device for depositing and distributing a liquid on the hair comprising:

a. a supply reservoir having an open end;

b. a cap portion attached to said open end of said supply reservoir, said cap portion having a first passageway therethrough communicating with the interior of said supply reservoir;

c. a comb tooth support member attached to said cap portion, said comb tooth support member having a passageway extending partially therethrough and communicating with said passageway through said cap portion;

d. a plurality of comb teeth each having a first passageway extending partially therethrough in a longitudinal direction and a second passageway extending laterally through said comb tooth and communicating with said first passage, said second passageway located at the approximate midpoint between the comb tooth ends to allow placement of the liquid onto the hair without contacting the scalp; and e. attachment means to removably attach said plurality of comb teeth to said comb teeth support member, such that each of said first passageways communicates with said passageway in said comb tooth support member.

2. The applicator device of claim 1 further comprising a. a flexible supply reservoir; and b. a valve in a second passageway through said cap portion communicating the interior of said supply reservoir with ambient atmosphere, said valve being closed when the flexible reservoir is deformed inwardly to prevent the passage of liquid from the interior of said flexible container therethrough, and opened when said flexible reservoir returns to its non-deformed condition to allow passage of air from the ambient atmosphere into said flexible container.

3. The applicator device of claim 2 wherein said comb tooth support member is rotatably attached to a cylinder extending at an angle from the upper surface of said cap portion and has a radially extending rotating lever to facilitate manual rotation thereof.

4. The applicator device of claim 3 wherein means are provided in the rotatable joint between the comb tooth support member and the cap portion to limit the rotation of said comb tooth support member to 180°.

5. The applicator device of claim 2 wherein said attachment means comprises:

a. first retaining means in the passageway of said comb tooth support member, and b. second retaining means on each of said comb teeth to engage said first retaining means and retain each of said teeth in position on said comb tooth support member.

6. The applicator device of claim 5 wherein said first retaining means is a groove located in each sidewall of said comb tooth support member passageway and said second retaining means is a ridge on each side of each of said comb teeth to engage said grooves.

7. The applicator device of claim 2 wherein said attachment means further comprises:

a. a base frame having the comb teeth mounted thereon, said base frame having passageways therethrough communicating with the first passageways in said plurality of teeth; and b. means to removably attach said base frame to said comb tooth support member, such that the passageways therethrough communicate with the passageway in said comb tooth support member.

8. The applicator device of claim 7 wherein said attaching means comprises a groove in each side of the comb tooth support member and a ridge on each side of said base frame to engage said grooves.

9. The applicator device of claim 7 wherein said comb teeth are formed integrally with said base frame.

10. The applicator device of claim 1 wherein said supply reservoir is located within and surrounded by a main container body having a pressurized propellant gas between said main container body and said supply reservoir to force said hair treating liquid from said supply reservoir.

* * * * *